US006113188A

United States Patent [19]

Stewart et al.

[11] Patent Number: 6,113,188

[45] Date of Patent: Sep. 5, 2000

[54] PORTABLE SEATING ASSIST DEVICE

[76] Inventors: Robert V. Stewart; Robert B. Stewart, both of 345 Scarboro Avenue S.W., Calgary, Alberta, Canada, T3C 2H5

[21] Appl. No.: 08/997,948

[22] Filed: Dec. 24, 1997

[51] Int. Cl.[7] ..... A47C 1/022

[52] U.S. Cl. ..... 297/339; 297/DIG. 3; 297/DIG. 8; 297/DIG. 10; 297/344.16

[58] Field of Search ..... 297/338, 339, 297/313, DIG. 3, DIG. 8, DIG. 10, 344.15, 344.16; 248/421, 631; 108/95

[56] References Cited

U.S. PATENT DOCUMENTS

| | | | |
|---|---|---|---|
| 3,250,569 | 5/1966 | Gaffney | 297/339 |
| 3,410,328 | 11/1968 | Sasai | 108/145 |
| 3,479,086 | 11/1969 | Sheridan | 297/DIG. 10 |
| 4,538,854 | 9/1985 | Wilson | 297/DIG. 8 |
| 4,592,589 | 6/1986 | Hellwig . | |
| 4,629,162 | 12/1986 | Porche . | |
| 4,688,851 | 8/1987 | Allen et al. . | |
| 4,905,329 | 3/1990 | Hellner . | |
| 4,993,736 | 2/1991 | Garman et al. | 297/DIG. 8 |
| 4,998,301 | 3/1991 | Markus . | |
| 5,116,100 | 5/1992 | Iversen . | |
| 5,169,112 | 12/1992 | Boyles et al. | 248/421 |
| 5,346,170 | 9/1994 | Schmidt et al. | 248/421 |
| 5,361,433 | 11/1994 | Vanzant . | |
| 5,375,910 | 12/1994 | Murphy . | |
| 5,398,994 | 3/1995 | Thomas . | |
| 5,505,518 | 4/1996 | Pike . | |
| 5,771,816 | 6/1998 | Zaguroli | 248/631 |

FOREIGN PATENT DOCUMENTS

| | | |
|---|---|---|
| 0161922 | 5/1985 | European Pat. Off. . |
| 0663198 | 1/1995 | European Pat. Off. . |
| WO 8908437 | 3/1989 | WIPO . |
| WO 9324072 | 5/1993 | WIPO . |
| WO 9531953 | 5/1994 | WIPO . |
| WO 9633685 | 4/1996 | WIPO . |

*Primary Examiner*—Anthony D. Barfield
*Attorney, Agent, or Firm*—Bennett Jones

[57] ABSTRACT

A portable device is provided for assisting persons with the acts of sitting down and rising from a seated position. The device comprises a base a seat, an inflatable air chamber and a battery powered air compressor. The air chamber, the compressor and the battery are self-contained within the base and seat, which fit together to form a case. The device further comprises three stabilizing scissor-braces which support and stabilize the side edges and the rear edge of the seat throughout its range of travel. The air chamber is preferably fashioned of non-stretch material. The device may also include a cable and spring mechanism to urge the seat into a closed position from a raised open position.

5 Claims, 3 Drawing Sheets

PORTABLE SEATING ASSIST DEVICE

FIELD OF INVENTION

The present invention relates to a portable seating assist device for assisting persons with the acts of sitting down and rising from a seated position.

BACKGROUND OF INVENTION

Many people experience difficulty in rising from a seated position or seating themselves from a standing position. This difficulty may arise from a variety of causes such as arthritis, other chronic illnesses, injuries or obesity.

The prior art demonstrates many attempts to assist such people with seating assist devices. In particular, pneumatically inflated devices are described in U.S. Pat. Nos. 4,629,162 (Porche, Dec. 16, 1982) and 5,361,433 (Vanzant, Nov. 8, 1994) and PCT Application PCT/GB96/01001 (Jeans). Each of these prior art devices includes an inflatable cushion and a detached blower unit, and each requires an external power source. Although these devices are portable, the separation of the cushion and the blower is an inconvenience. Further, these devices may only be used where an external power source is available, such as ordinary household electrical outlets.

Other prior art devices are more portable and do not require external power. The device described in European Patent Application No. 95200105.5 (Haan) uses a support member which is urged by torsion leaf springs to a raised position above a base member. The support member is hinged to the base member using an intermediate support member which allows the support member to remain relatively horizontal through its range of motion. Other hinged devices such as that described in U.S. Pat. No. 5,116,100 (Iversen, May 26, 1992) cause their users to be propelled forward rather than lifted upwards which is a significant disadvantage. The Haan device suffers from the drawback of all spring-activated devices in that the level of assist is governed by the strength of the spring. If too strong a spring is used, the device becomes difficult to use, as the speed of assist is uncontrollable. The device also becomes very difficult to close. If the spring is not strong enough, there is insufficient force to provide any real assistance to the user.

The prior art devices also suffer from a lack of stability or steadiness. Spring-activated devices will bob up and down as the user shifts his or her weight. The Vanzant device attempts to provide stabilization by inflating rear and side wall cavities first before inflating the centre cavity.

There is therefore a need in the art for a seating assist device which is conveniently portable, self-contained and which may be used on any seating surface. It may be further advantageous if such a device were to be stable and allow convenient operation which is controllable and adjustable by the user.

SUMMARY OF THE INVENTION

The present invention provides a seating assist device which is entirely selfcontained and conveniently portable.

In one aspect of the invention, broadly stated, the device comprises:

(a) a base member;

(b) a seat member movable from a lowered position to a raised position above the base member;

(c) means to stabilize the seat member;

(d) means for lifting the seat member upwards; and (e) power means for powering the lift means;

wherein the stabilizing means, lift means and power means are each disposed between the base member and the seat member.

The base member and seat member preferably fit together to form an enclosed space between them, and the other elements of the invention are contained within the enclosed space. It is convenient but not essential to have the base and seat members shaped rectangularly, each having a front edge, a rear edge and two side edges.

The stabilizing means may comprise two scissor braces stabilizing the two side edges of the seat member, each scissor brace comprising first and second brace members pivotally interconnected along their lengths. The first brace member is pivotally fixed to the base member at one end and slidingly engages the seat member at the other end and the second brace member is pivotally fixed to the seat member at one end and slidingly engages the base member at the other end. Preferably, there are three scissor braces, one stabilizing each of two side edges and the rear edge of the seat member.

The lift means and the power means are preferably an air chamber inflatable by a battery powered air compressor. The air chamber may be fashioned of a non-stretch material that will not allow further expansion once the chamber is fully inflated and the weight of a user is brought to bear on the seat member.

In another aspect of the invention, the device comprises:

(a) a base member;

(b) a seat member movable from a lowered position to a raised position above the base member;

(c) means for lifting the seat member upwards, said lift means disposed between the seat and base members;

(d) power means for powering the lift means, said power means connected to the lift means; and (e) at least two scissor-braces disposed between the base member and the seat member such that one scissor-brace is at a substantially right angle to at least one other scissor-brace, the two scissor-braces supporting and stabilizing the seat member throughout its range of motion.

BRIEF DESCRIPTION OF THE DRAWINGS

The preferred embodiment of the invention will now be described with reference to the accompanying drawings in which.

DETAILED DESCRIPTION OF THE INVENTION

Figure 1:
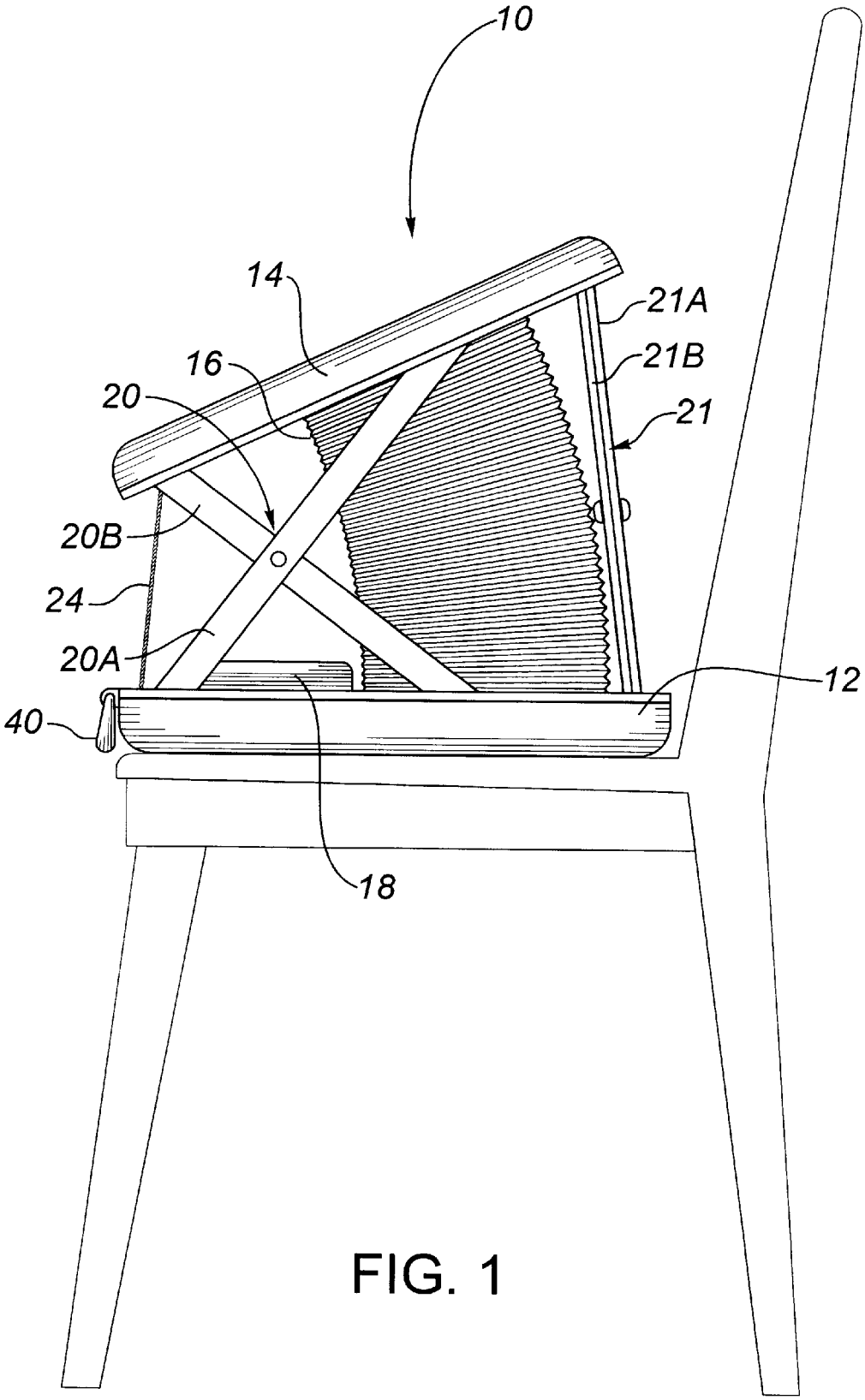
FIG. 1 is a side view of the device in its raised position on a chair.

Referring to FIG. 1, the present invention, generally represented by reference number (10), is shown in its raised position, placed on a chair.

Figure 2:
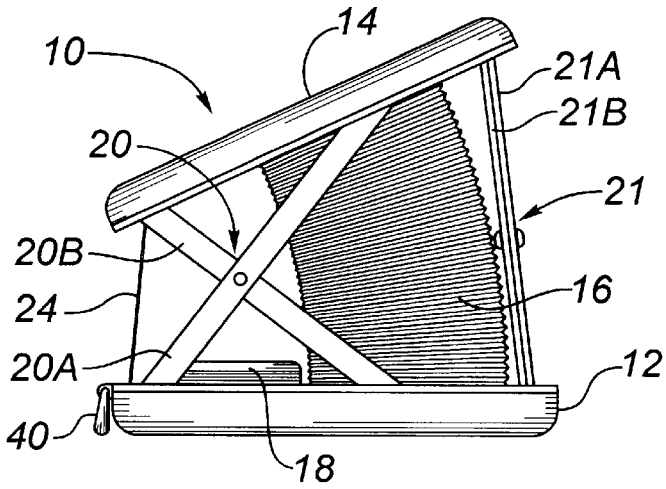
FIG. 2 is a side view of the device in its raised position.
Figure 3:
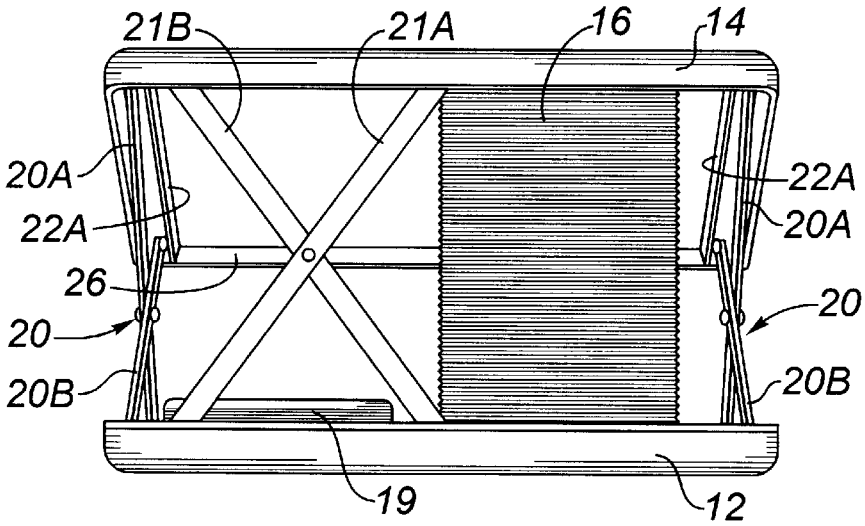
FIG. 3 is a rear view of the device in its raised position.

Referring to FIGS. 1, 2, and 3, the preferred embodiment of the invention comprises, in part, a base member (12), a seat member (14), an inflatable air chamber (16), an electric air compressor (18), a battery (19) for supplying electrical power to the compressor (18), two scissor-braces (20) along the sides of the invention, and a further scissor-brace (21) along the rear of the invention. The base member (12) and the seat member (14) are shaped so as to fit together and, when so fitted together, to enclose a space which houses the air chamber (16), compressor (18), battery (19), scissor-braces (20, 21), and related components. The air chamber (16) is preferably a polyurethane fabric tube which is fastened in air-tight fashion to the inner faces of the base member (12) and the seat member (14), and is connected to the compressor (18) in air-tight fashion by means of an air hose (not shown). Suitable air compressors which are compact enough to fit within the base and seat members (12, 14), are powerful enough to inflate the air chamber (16) against the weight of a user, and which may be battery powered, are readily commercially available.

The base member (12) and the seat member (14) may be fabricated from any suitable plastic or metal. In the preferred embodiment, these members (12, 14) are fabricated from injection molded polypropylene.

Each side scissor-brace (20) and the rear scissor-brace (21) comprises a first brace member (20*a*, 21*a*) and a second brace member (20*b*, 21*b*), which are pivotally interconnected along their lengths. One end of the first brace member (20*a*, 21*a*) is pivotally fixed to the base member (12), and the other end slidably engages the seat member (14). Similarly, one end of the second brace member (20*b*, 21*b*) is pivotally fixed to the seat member (14), and the other end slidably engages the base member (12).

Figure 5:
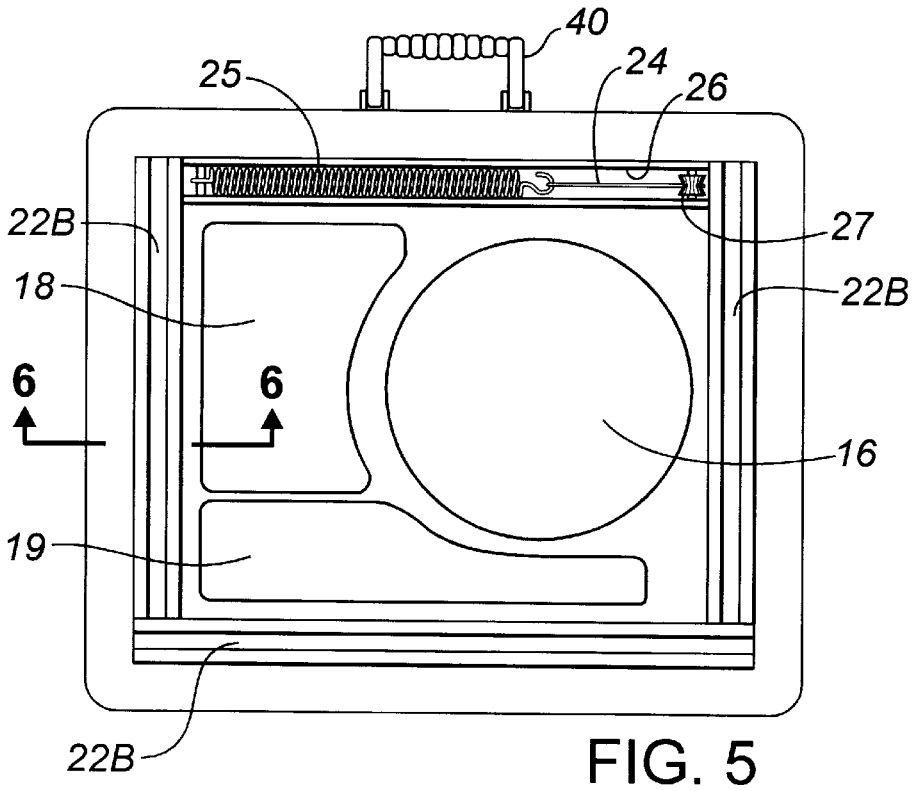
FIG. 5 is a cross-sectional view along 5—5 in FIG. 7.
Figure 6:
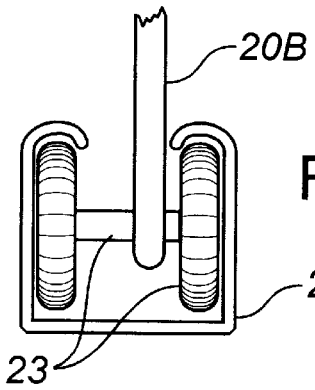
FIG. 6 is a cross-sectional detail of the track and roller mechanism of the support braces, along 6—6 in FIG. 5.

In the preferred embodiment, the slidable engagement of the brace members is facilitated by elongate upper tracks (22*a*) fixed to the seat member (14) as shown in FIG. 3, and by elongate lower tracks (22*b*) fixed to the base member (12) as shown in FIG. 5. As illustrated in FIG. 6, the slidably engaged end of each brace member is rotatably mounted to a roller assembly (23) retained within the tracks (22*a* and 22*b*).

Figure 4:
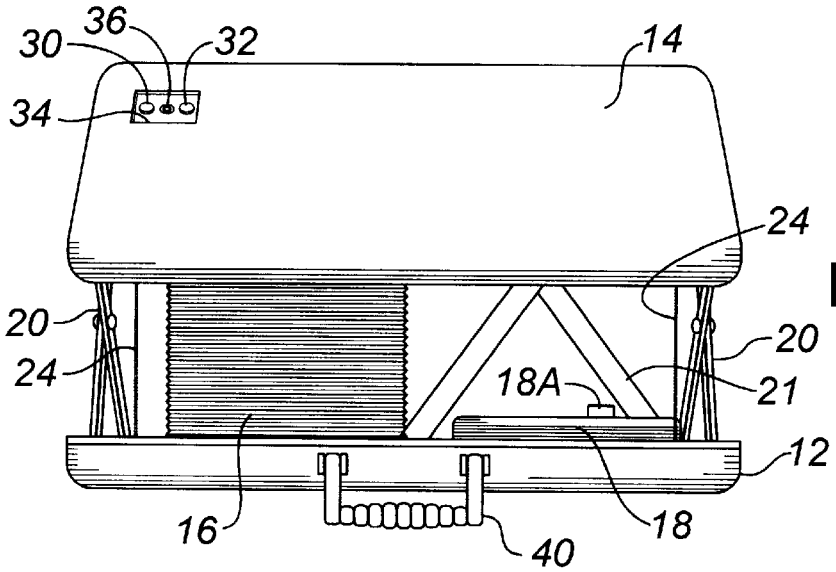
FIG. 4 is a front view of the device in its raised position.
Figure 7:
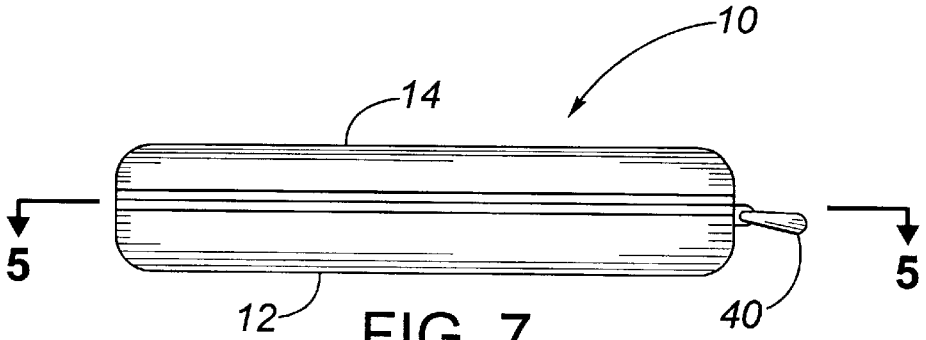
FIG. 7 is a side view of the device in its lowered position.

The preferred embodiment further comprises a lift control switch (30) and a lowering valve (32), which may be mounted in a recess (34) in the seat member (14) as shown in FIG. 4. Also shown in FIG. 4 is the recharging outlet (36) where a converted AC-DC adaptor (not shown) may be connected in order to recharge the battery (19). When the invention is in the closed position, as illustrated in FIG. 7, operation of the lift control switch (30) will activate the compressor (18), which in turn will pump air through the air hose into the air chamber (16), inflating the air chamber (16) and raising the seat member (14). This raising operation may be carried out with or without a person sitting on the seat member (14). It is readily seen that the seat member (14) may be deployed in a variety of positions depending on the extent to which the air chamber (16) is inflated.

The upward movement of the seat member (14) causes the sliding ends of the scissor-brace members to slide inwardly in their corresponding tracks (22*a* and 22*b*), such that each scissor-brace assembly (20, 21) assumes the approximate shape of the letter X. The selected geometric configuration of the side scissor-braces (20) will determine the angular orientation of the seat member (14) as it progresses from the fully closed position to the fully open position. If the intersection of the scissor-brace members (21*a*, 21*b*) is centered, then the seat member (14) will be raised straight up, as is the case with the rear scissor-brace (21) in the preferred embodiment. In the preferred embodiment, the seat member (14) tilts slightly forward as it rises. The tilt is introduced by the off-center intersection of the brace members of the two side scissor-braces (20) as shown in FIG. 2. The figures show the preferred embodiment where the front and rear edges of the seat member (14) remain horizontal throughout its range of travel.

In the preferred embodiment, the invention further comprises an automatic lift limit switch (18*a*), which will de-activate the compressor (18) when the seat member (14) has been raised to a pre-determined position. The lift limit switch thereby prevents the various components of the invention from being overstressed by excessive pressure build-up in the air chamber (16).

When the invention is in the open position, as illustrated in FIGS. 1, 2, 3, and 4, it may be lowered by actuating the lowering valve (32), which causes air to be released from the air chamber (16). The seat member (14) may then be lowered as air leaves the air chamber (16), whether or not a person is sitting on the seat member (14). The downward movement of the seat member (14) causes the sliding ends of the scissor-brace members (20*a*, 20*b*, 21*a* and 21*b*) to slide outwardly in their corresponding tracks (22*a* and 22*b*) such that the scissor-brace assemblies (20, 21) become progressively flatter until the invention reaches the fully closed position.

The invention may further comprise a mechanism to increase the speed at which the seat member (14) is lowered after actuation of the lowering valve (32) by increasing the rate of deflation of the air chamber (16). In the preferred embodiment, this mechanism comprises two cables (24), as illustrated in FIGS. 1, 2, 4, and 5, to increase the rate at which the seat member (14) will be lowered upon actuation of the lowering valve (32). One cable (24) is attached at one end to the seat member (14) and then passes around and under a pulley (27) which is rotatably mounted within an elongate channel (26) fixed to the base member (12), and is then fastened to one end of a coil spring (25), which is positioned within the channel (26) and anchored at one end thereto. The other cable (24) is similarly attached at one end to the base member (12) and then passes around and under a further pulley (27) which is rotatably mounted within a further elongate channel (26) fixed to the seat member (14), and then fastened to one end of a further coil spring (25), which is positioned within the channel (26) and anchored at one end thereto.

When the invention is raised from the closed position to an open position, the cables (24) will exert tension on the springs (25). When the lowering valve (32) is activated, the tension in the springs (25) acts to pull the seat member (14) down, thus assisting the lowering process. The assist provided by the cables (24) and springs (25) is of particular benefit when it is desired to close the invention without anyone sitting on it. The springs (25) should not be so strong as to impair the ability of the compressor (18) to inflate the air chamber (16) in normal use.

In the preferred embodiment, the lowering valve (32) incorporates an automatic re-set feature (not shown), whereby the lowering valve (32) will close automatically when the invention reaches the fully closed position, such that the device (10) will be ready for immediate re-use if desired.

In the preferred embodiment, the battery (19) is rechargeable, and the invention further comprises a battery conditioner (not shown) mounted in the space enclosed by the base member (12) and the seat member (14) which acts to prevent overcharging of the battery (19). Suitable batteries and conditioners are very well known in the art. In the preferred embodiment, a 12 V DC, nickel-cadmium battery is used.

In the preferred embodiment of the invention, the bottom of the base member (12) will have ridges (not shown) formed therein, so as to minimize the potential for slippage of the base member (12) relative to the surface upon which it is positioned. The invention will further comprise a carrying handle (40), ideally connected to the front edge of the base member (12) as shown in FIGS. 1, 2, 4, 5, and 7. When in the closed position, the invention resembles a compact attache case and is as portable as such.

A user may carry the invention and place it on a seating surface such as a chair. The user may then activate the air compressor (18) by pressing the lift control switch (30). The compressor (18) fills the air chamber (16) and causes the seat member (14) to rise to its open, raised position, as shown in FIGS. 2, 3 and 4. The user may then sit on the raised seat member (14). In the preferred embodiment, the air chamber (16) is fabricated from polyurethane fabric which does not stretch. As a result, the device (10) does not compress when the user sits on it. As well, the seat member (14) does not rock in any direction because of the three scissor-braces (20, 21) stabilizing it.

Once the user is supported by the seat member (14), he or she may lower the seat member (14) by activating the lowering valve (32). The seat member (14) then is lowered to its closed position. The user is now in a comfortable seated position on the closed device (10). The process of raising the seat member (14) is repeated to assist the user to a standing position.

Alternatively, the device (10) in its closed state may be positioned underneath a prone or seated person in need of assistance and activated to assist that person to a standing position.

The foregoing description of the preferred embodiment of the invention is illustrative only of the invention. Numerous modifications and changes will be apparent to those skilled in the art which fall within the scope of the claimed invention. For example, it is not essential to this invention that the lift means comprise an inflatable air chamber and an air compressor. It is contemplated that the lift means may comprise an electric motor which physically lifts the seat member (14) by a variety of possible lift mechanisms. As a further example, the mechanism to increase the deflation of the air chamber (16) may take a variety of different forms which are within the scope of the claims below.

The configuration and structure of the lift means, the power means, the various valves and switches may take any variety of forms. What is essential and claimed as novel is that all such elements be self-contained within the device (10) or associated with the device (10) so as not to unduly impair portability or convenience.

The scissor-braces (20, 21) may be deployed in a number of alternative configurations. Stability of the seat member (14) results from the rear scissor-brace (21) which prevents side-to-side rocking of the seat member (14) in combination with the two side scissor-braces (20) which prevent fore-aft rocking of the seat member (14). As a result, the seat member (14) is rigidly supported when in any raised position.

The embodiments of the invention in which an exclusive property and privilege are claimed are as follows:

1. A portable self-contained seating assist device comprising:

(a) a base member having a front edge, a rear edge and two side edges;

(b) a seat member having a front edge, a rear edge and two side edges, said seat member movable from a lowered position to a raised position above the base member;

(c) means for stabilizing the two side edges of the seat member;

(d) means for stabilizing the rear edge of the seat member;

(e) means for lifting the seat member upwards comprising an inflatable non-stretch air chamber and an air compressor connected to the air chamber;

(f) means for powering the lift means; and (g) means for increasing the rate of deflation of the air chamber to lower the seat member comprising:

i. a pair of elongate front channel member, one such channel being affixed to the lower surface of the seat member adjacent to the front edge thereof, and the other channel being similar affixed to the upper surface of the base member;

ii. a pair of pulleys, one of which is rotatably mounted within each of the front channels and near one end thereof;

iii a pair of springs, one of which is positioned within each of the front channels, and one end of which is anchored to its corresponding channel near the end opposite the pulley mounted in that channel;

iv. a cable attached at one end to the unanchored end of the spring in the front channel of the seat member, passing over and around the pulley in the front channel of the seat member, and attached at its other end to the base member near the front thereof;

v. a cable attached at one end to the unanchored end of the spring in the front channel of the base member, passing under and around the pulley in the front channel of the base member, and attached at its other end to the seat member near the front thereof;

wherein the stabilizing means, lift means and power means are each disposed between the base member and the seat member.

2. The device of claim 1 wherein the power means is a battery.

3. The device of claim 2 wherein the battery is rechargeable.

4. The device of claim 1 further comprising a lift control switch for activating the compressor.

5. The device of claim 1 further comprising an automatic lift limit switch for automatically de-activating the compressor upon the seat member being deployed to a predetermined position.

* * * * *